US011201413B1

(12) United States Patent
Lin

(10) Patent No.: US 11,201,413 B1
(45) Date of Patent: Dec. 14, 2021

(54) ANTENNA MODULE AND ELECTRONIC DEVICE

(71) Applicant: Wistron Corporation, New Taipei (TW)

(72) Inventor: Po-Tsang Lin, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 17/128,210

(22) Filed: Dec. 21, 2020

(30) Foreign Application Priority Data

Nov. 9, 2020 (TW) ..... 109139010

(51) Int. Cl.

| | |
|---|---|
| ***H01Q 21/28*** | (2006.01) |
| ***H01Q 1/22*** | (2006.01) |
| ***H01Q 5/364*** | (2015.01) |
| ***H01Q 21/00*** | (2006.01) |
| ***H01Q 1/12*** | (2006.01) |

(52) U.S. Cl.
CPC ..... *H01Q 21/0025* (2013.01); *H01Q 1/12* (2013.01); *H01Q 1/2291* (2013.01); *H01Q 5/364* (2015.01); *H01Q 21/28* (2013.01)

(58) Field of Classification Search
CPC ..... H01Q 5/30; H01Q 5/307; H01Q 5/364; H01Q 1/2291; H01Q 1/242; H01Q 21/28
See application file for complete search history.

(56) References Cited

U.S. PATENT DOCUMENTS

| | | | | |
|---|---|---|---|---|
| 7,501,987 | B2 * | 3/2009 | Wang | H01Q 1/243 343/700 MS |
| 7,868,831 | B2 * | 1/2011 | Hung | H01Q 5/371 343/700 MS |
| 8,072,389 | B2 * | 12/2011 | Chang | H01Q 5/378 343/846 |
| 8,299,972 | B2 | 10/2012 | Lai | |

(Continued)

FOREIGN PATENT DOCUMENTS

| | | |
|---|---|---|
| TW | I515971 | 1/2016 |
| TW | I619314 | 3/2018 |
| TW | M599482 | 8/2020 |

OTHER PUBLICATIONS

"Office Action of Taiwan Counterpart Application", dated Mar. 31, 2021, p. 1-p. 6.

(Continued)

*Primary Examiner* — Jason Crawford
(74) *Attorney, Agent, or Firm* — JCIPRNET

(57) ABSTRACT

An antenna module includes a first antenna including a first radiator, a second radiator, a third radiator, a fourth radiator, and a fifth radiator. The first radiator has a first end and a second end opposite to each other. The first end is a first feeding end, and the second radiator, the third radiator and the fourth radiator are connected to the second end of the first radiator. The second radiator has a plurality of bending portions. The fifth radiator is connected to the second radiator, and the fifth radiator has a first ground terminal. The first radiator, the second radiator and the fifth radiator (Continued)

resonate in a first frequency band, the first radiator and the third radiator resonate in a second frequency band, and the first radiator and the fourth radiator resonate in a third frequency band.

10 Claims, 14 Drawing Sheets

(56) References Cited

U.S. PATENT DOCUMENTS

| | | | | |
|---|---|---|---|---|
| 8,441,399 | B2 * | 5/2013 | Wu | H01Q 1/2258 343/700 MS |
| 9,318,796 | B2 | 4/2016 | Hsu et al. | |
| 9,484,631 | B1 * | 11/2016 | Napoles | H01Q 5/371 |
| 2007/0046548 | A1 * | 3/2007 | Pros | H01Q 9/42 343/702 |
| 2011/0215980 | A1 * | 9/2011 | Lai | H01Q 13/10 343/770 |
| 2012/0154230 | A1 * | 6/2012 | Wang | H01Q 5/357 343/725 |
| 2013/0321219 | A1 * | 12/2013 | Cho | H01Q 9/0421 343/702 |
| 2014/0313083 | A1 * | 10/2014 | Hsu | H01Q 5/371 343/700 MS |
| 2014/0333506 | A1 * | 11/2014 | Yang | H01Q 5/307 343/906 |
| 2015/0333400 | A1 * | 11/2015 | Huang | H01Q 5/371 343/700 MS |
| 2018/0288203 | A1 * | 10/2018 | Jeon | H01Q 5/35 |
| 2019/0109622 | A1 * | 4/2019 | Wang | H04B 7/0452 |
| 2021/0005984 | A1 * | 1/2021 | Liu | H01Q 21/30 |

OTHER PUBLICATIONS

"Office Action of Taiwan Counterpart Application", dated Oct. 6, 2021, p. 1-p. 7.

* cited by examiner

ANTENNA MODULE AND ELECTRONIC DEVICE

CROSS-REFERENCE TO RELATED APPLICATION

This application claims the priority benefit of Taiwan application serial no. 109139010, filed on Nov. 9, 2020. The entirety of the above-mentioned patent application is hereby incorporated by reference herein and made a part of this specification.

BACKGROUND OF THE INVENTION

Field of the Invention

The invention relates to an antenna module and an electronic device, and particularly relates to a multi-frequency antenna module and an electronic device including the frequency band.

Description of Related Art

With the advancement of science and technology, the demand for multi-band antennas has gradually increased. How to develop an antenna capable of coupling multiple frequency bands now becomes an issue to work on.

SUMMARY OF THE INVENTION

An aspect of the invention provides an antenna module which meets the demand for multiple frequency bands.

An aspect of the invention provides an electronic device having the antenna module.

An antenna module according to an aspect of the invention includes a first antenna including a first radiator, a second radiator, a third radiator, a fourth radiator, and a fifth radiator. The first radiator has a first end and a second end opposite to each other. The first end is a first feeding end. The second radiator, the third radiator and the fourth radiator are connected to the second end of the first radiator. The second radiator has a plurality of bending portions. The fifth radiator is connected to the second radiator. The fifth radiator has a first grounding end. The first radiator, the second radiator and the fifth radiator resonate in a first frequency band, the first radiator and the third radiator resonate in a second frequency band, and the first radiator and the fourth radiator resonate in a third frequency band.

According to an embodiment of the invention, the second radiator includes a first segment, a second segment, a third segment, and a fourth segment, the first segment is connected to the second end of the first radiator, the second segment is bent and connected to the first segment, the third segment and the fourth segment are respectively bent and connected to the second segment, and widths of the second segment and the third segment are respectively greater than widths of the first segment and the fourth segment.

According to an embodiment of the invention, the width of the second segment is 2 times to 4 times of the width of the first segment.

According to an embodiment of the invention, the width of the third segment is 1.5 times to 3 times of the width of the first segment.

According to an embodiment of the invention, the first segment of the second radiator and the third radiator extend in directions opposite to each other.

According to an embodiment of the invention, the fourth segment of the second radiator includes a first conductive hole adapted to penetrate through a frame for connection with the fifth radiator.

According to an embodiment of the invention, the fifth radiator is located beside the first radiator and parallel to the first radiator.

According to an embodiment of the invention, the first frequency band ranges between 2400 MHz and 2500 MHz, the second frequency band ranges between 5150 MHz and 5850 MHz, and the third frequency band ranges between 6125 MHz and 7125 MHz.

An electronic device according to an aspect of the invention includes a frame and the antenna module. The frame includes a top surface, a first inclined surface, a first side surface, a bottom surface, a second inclined surface, and a third inclined surface connected with one another. The second inclined surface is located below the top surface and connected with the bottom surface, and the third inclined surface is connected with the top surface. The first antenna is disposed on the top surface, the first inclined surface, the first side surface, the bottom surface, the second inclined surface, and the third inclined surface.

According to an embodiment of the invention, the first radiator extends from the bottom surface to the first side surface, the first feeding end is located on the bottom surface, the second radiator extends from the first side surface and the first inclined surface to the top surface and the third inclined surface, the third radiator is disposed on the first side surface, the fourth radiator is disposed on the first inclined surface, the fifth radiator extends from the bottom surface to the second inclined surface, and the first grounding end is located on the bottom surface.

An antenna module according to an aspect of the invention includes a second antenna including a sixth radiator, a seventh radiator, an eighth radiator, and a ninth radiator. The sixth radiator has a second feeding end. A portion of the seventh radiator is disposed beside and in parallel to a fifth segment of the sixth radiator. The eighth radiator is connected to the seventh radiator. The eighth radiator has a second grounding end. The ninth radiator extends from the sixth radiator. The sixth radiator, the seventh radiator and the eighth radiator resonate in a first frequency band, the sixth radiator resonates in a second frequency band, and a portion of the sixth radiator and the ninth radiator resonate in a third frequency band.

According to an embodiment of the invention, a portion of the eighth radiator is disposed beside and in parallel to a sixth segment of the sixth radiator.

According to an embodiment of the invention, the seventh radiator has a seventh segment and an eighth segment bent to be connected, the seventh segment of the seventh radiator is parallel to the fifth segment of the sixth radiator, and the eighth segment of the seventh radiator is parallel to the sixth segment of the sixth radiator.

According to an embodiment of the invention, the eighth segment of the seventh radiator includes a second conductive hole adapted to penetrate through a frame for connection with the eighth radiator.

According to an embodiment of the invention, the ninth radiator is parallel to the sixth segment of the sixth radiator.

According to an embodiment of the invention, the first frequency band ranges between 2400 MHz and 2500 MHz, the second frequency band ranges between 5150 MHz and 5850 MHz, and the third frequency band ranges between 6125 MHz and 7125 MHz.

An electronic device according to an aspect of the invention includes a frame and the antenna module. The frame includes a top surface, a fourth inclined surface, a second side surface, a bottom surface, and a fifth inclined surface connected with one another. The fifth inclined surface is located below the top surface and connected with the bottom surface. The second antenna is disposed on the top surface, the fourth inclined surface, the second side surface, the bottom surface, the fifth inclined surface.

According to an aspect of the invention, the sixth radiator extends from the bottom surface and the second side surface to the fourth inclined surface, the second feeding end is located on the bottom surface, the seventh radiator extends from the fourth inclined surface to the top surface, the eighth radiator extends from the fifth inclined surface to the bottom surface, and the second grounding end is located on the bottom surface.

Based on the above, in the antenna module according to the embodiments of the invention, the first end of the first radiator is provided with the first feeding end, the second radiator, the third radiator, and the fourth radiator are connected to the second end of the first radiator, the fifth radiator is connected to the second radiator, and the fifth radiator has the first grounding end. The first radiator, the second radiator and the fifth radiator resonate in the first frequency band, the first radiator and the third radiator resonate in the second frequency band, and the first radiator and the fourth radiator resonate in the third frequency band. With the above configuration, the antenna module according to the embodiments of the invention is able to meet the demand for multiple frequency bands.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
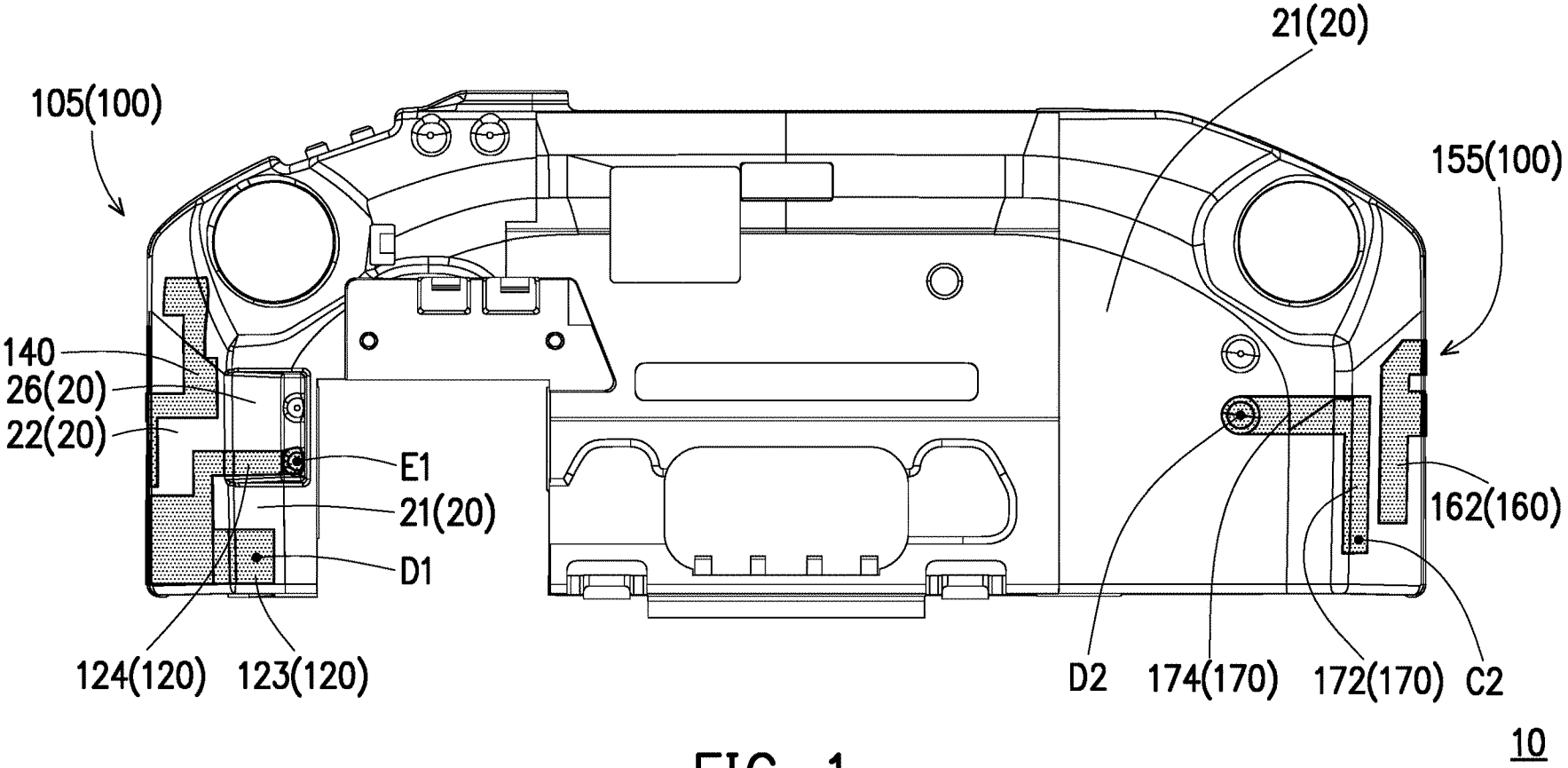
FIG. 1 is a schematic top view illustrating that an antenna module according to an embodiment of the invention is disposed on a frame.

Reference will now be made in detail to the present preferred embodiments of the invention, examples of which are illustrated in the accompanying drawings. Wherever possible, the same reference numbers are used in the drawings and the description to refer to the same or like parts.

The main technical improvement of the latest generation of wireless local area network technology WIFI-6 802.11ax is divided into two stages. The first stage is to use the existing frequency band range of 2.4G and 5G frequency bands to increase the overall transmission rate through increasing the signal processing technology. The second stage is to increase the bandwidth of the actual spectrum used. The original 5G frequency band (5150-5850 MHz) is extended to the 6G frequency band (5925 MHz to 7125 MHz) to increase the usable bandwidth range, which is the so-called WIFI 6E.

At present, the antenna design of products on the market only covers the ranges of 2.4 frequency band and 5G frequency band. In order to meet the bandwidth requirements of WIFI 6E, it is necessary to extend the bandwidth range of the 5G high frequency band to the 6G frequency band by expanding from the original 1 GHz to 2 GHz. In this way, it is necessary to double the bandwidth range, which greatly increases the difficulty of antenna design. The following will introduce an antenna module 100 that meets the bandwidth requirements of WIFI 6E and an electronic device 10 having the antenna module 100.

Figure 2:
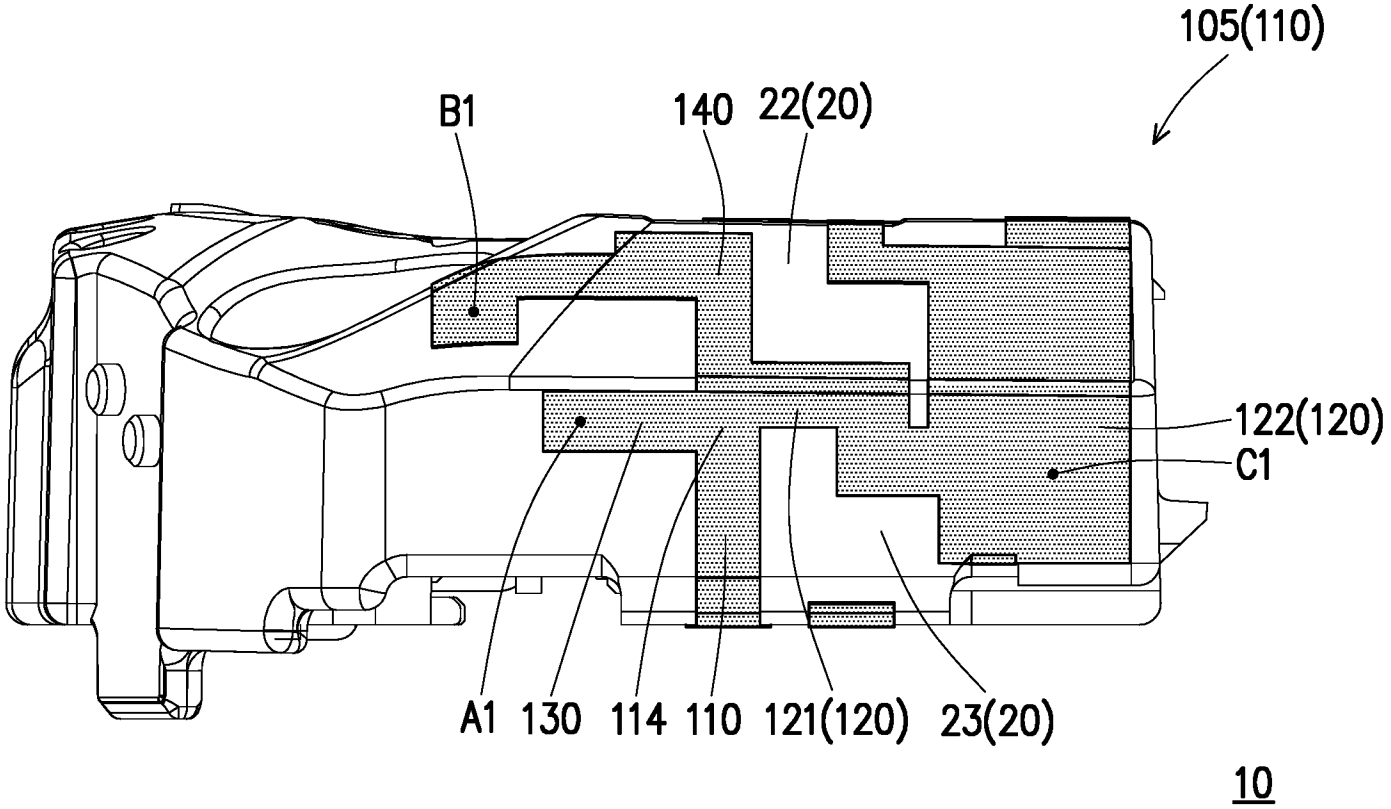
FIG. 2 is a schematic view of the left side of FIG. 1.
Figure 3:
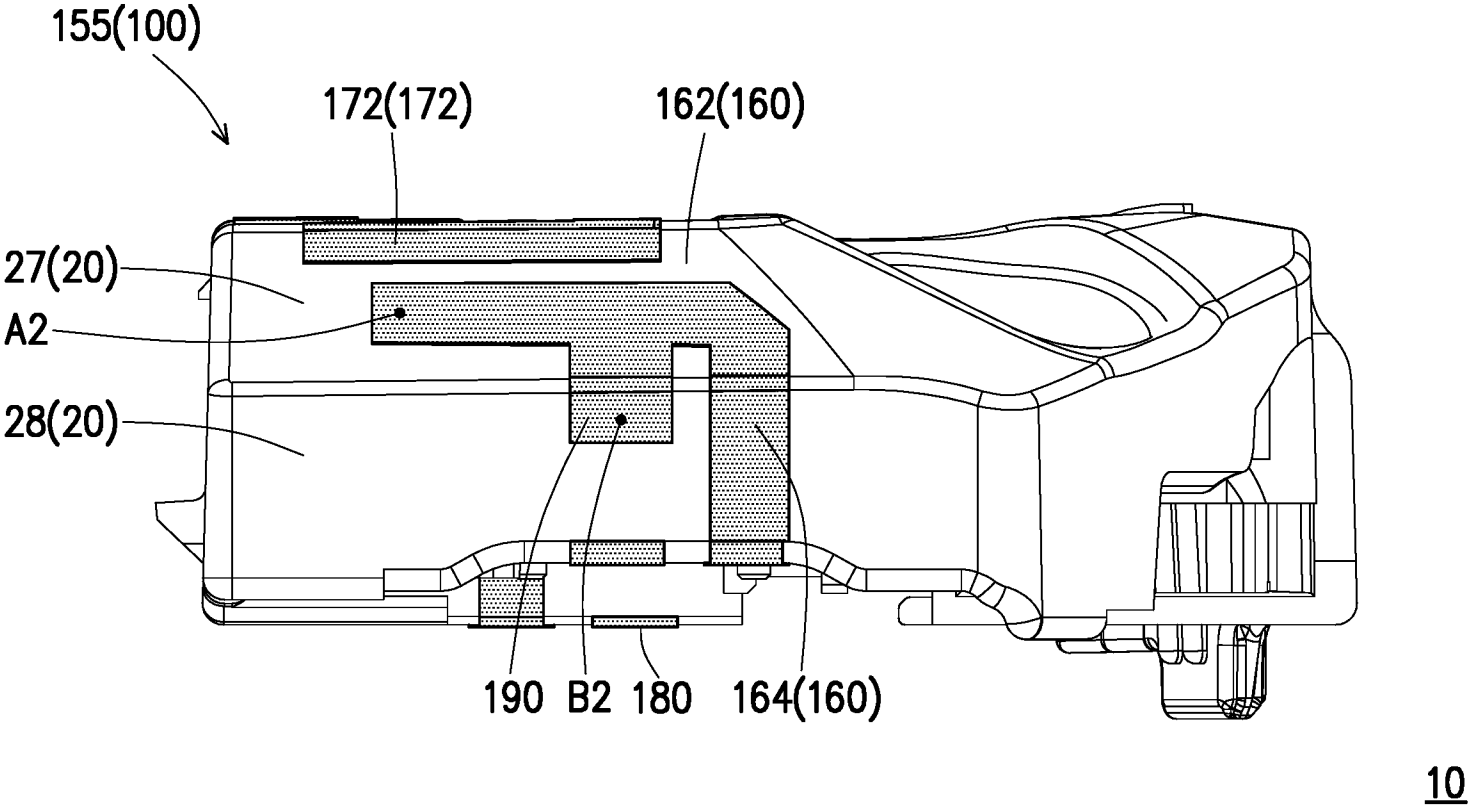
FIG. 3 is a schematic view of the right side of FIG. 1.
Figure 4:
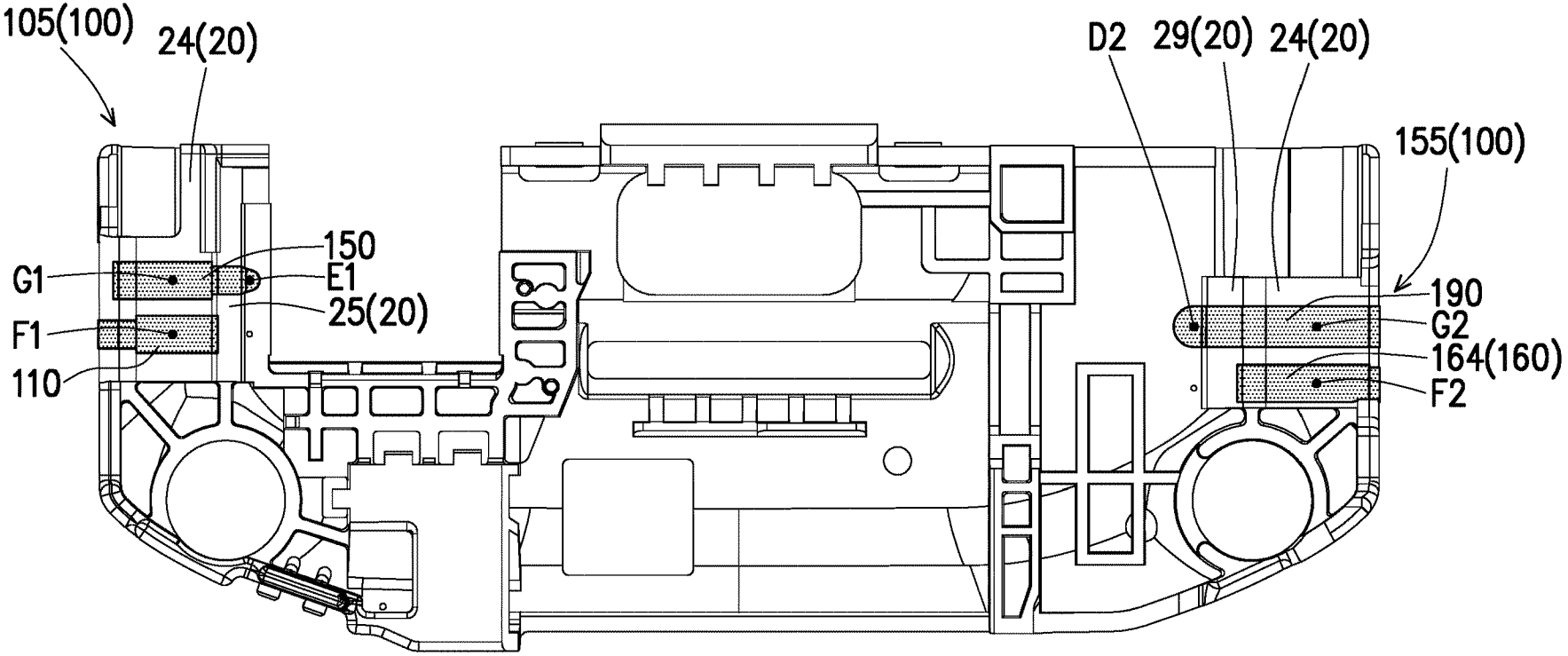
FIG. 4 is a schematic bottom view of FIG. 1.
Figure 5A:
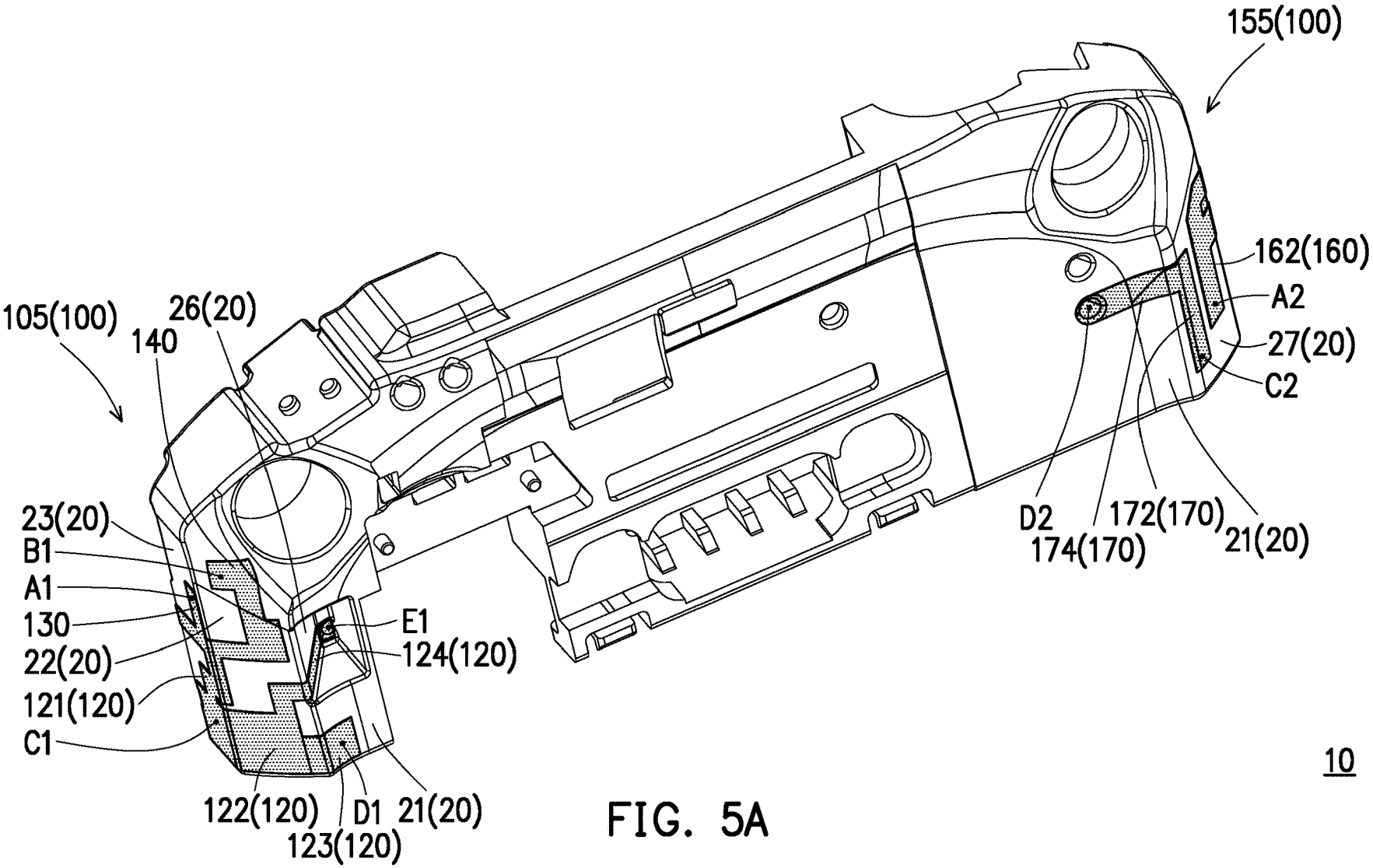
FIG. 5A is a schematic perspective view of FIG. 1.
Figure 5C:
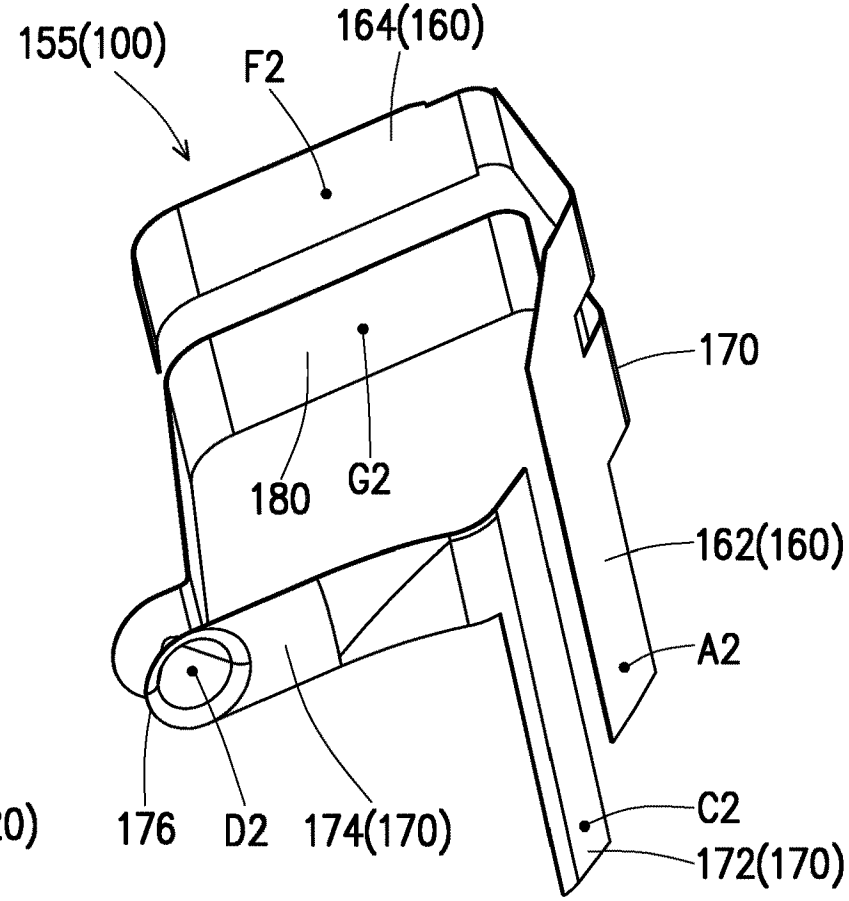
FIG. 5C is a schematic view of a second antenna of FIG. 5A.
Figure 5B:
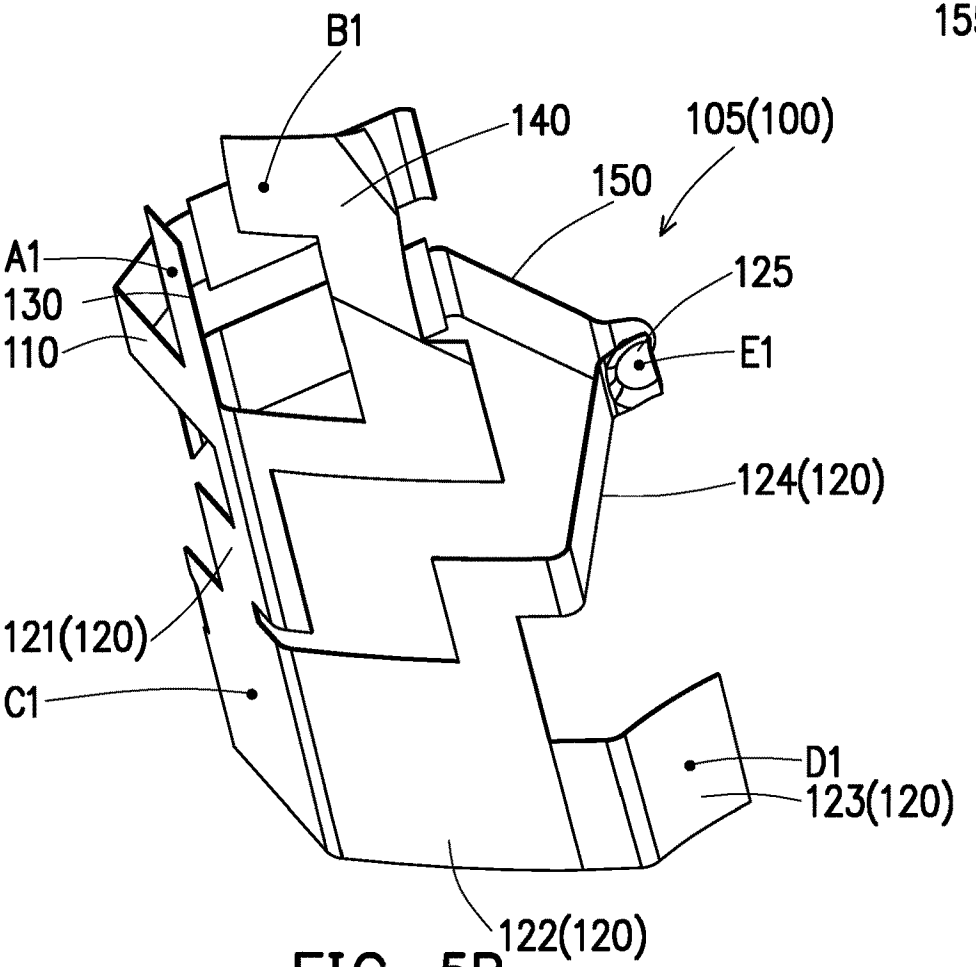
FIG. 5B is a schematic view of a first antenna of FIG. 5A.
Figure 6A:
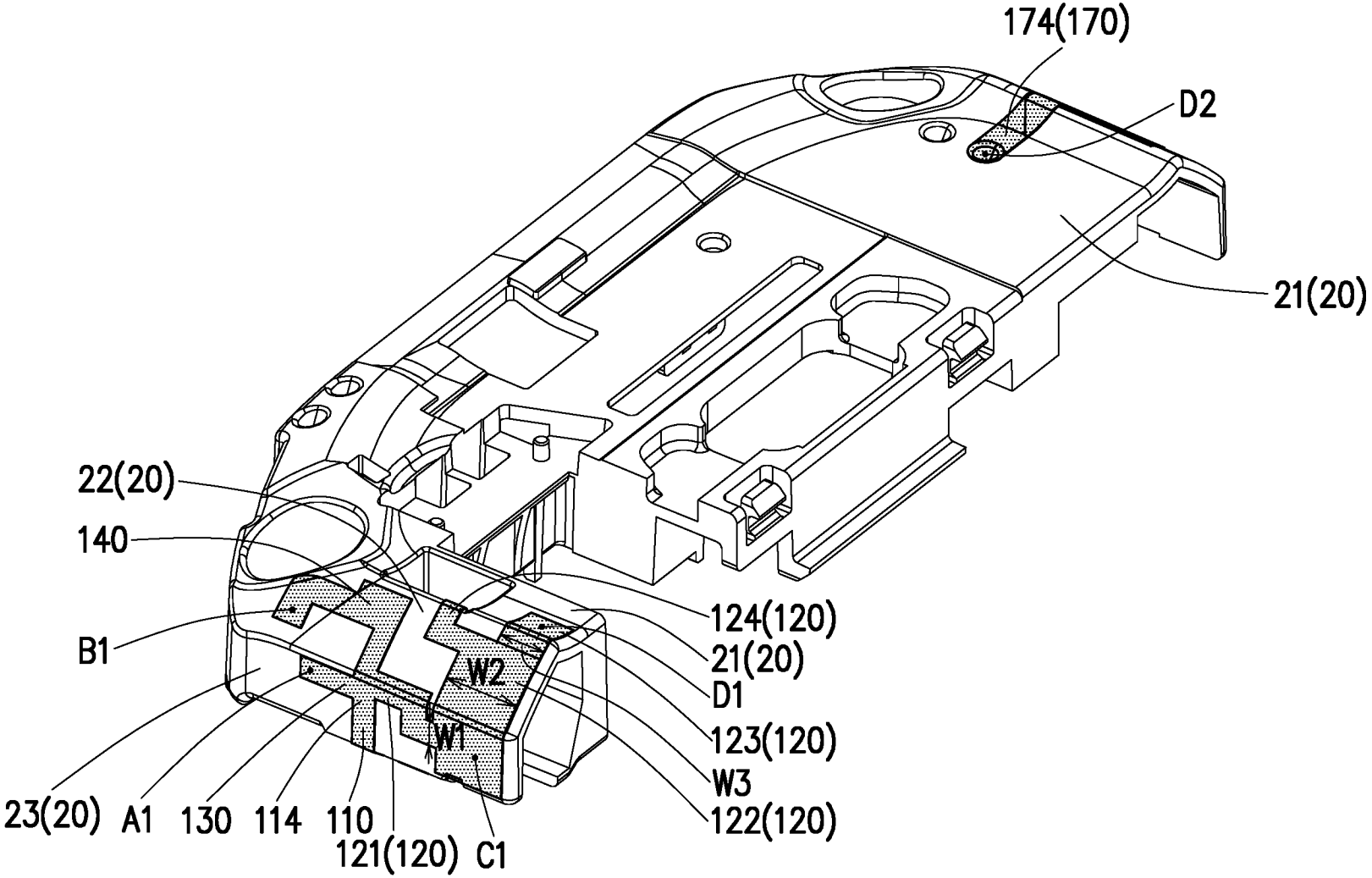
FIG. 6A is a schematic perspective view of FIG. 1 from another perspective.
Figure 6C:
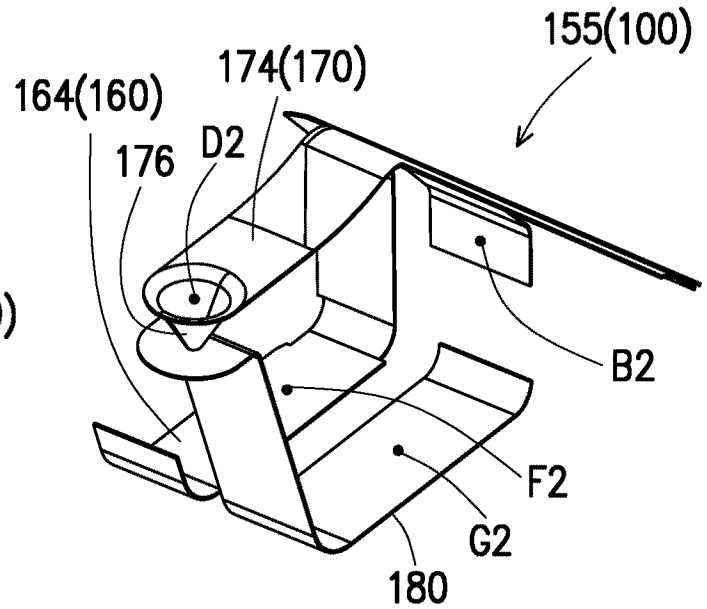
FIG. 6C is a schematic view of a second antenna of FIG. 6A.
Figure 6B:
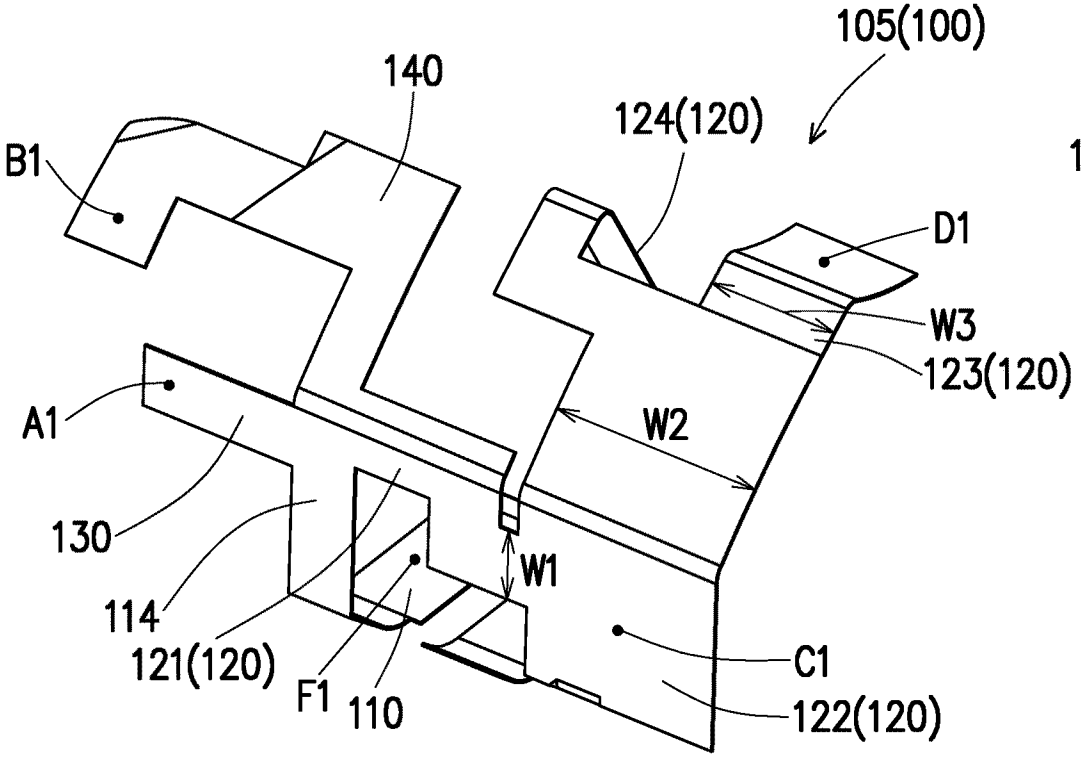
FIG. 6B is a schematic view of a first antenna of FIG. 6A.
Figure 7A:
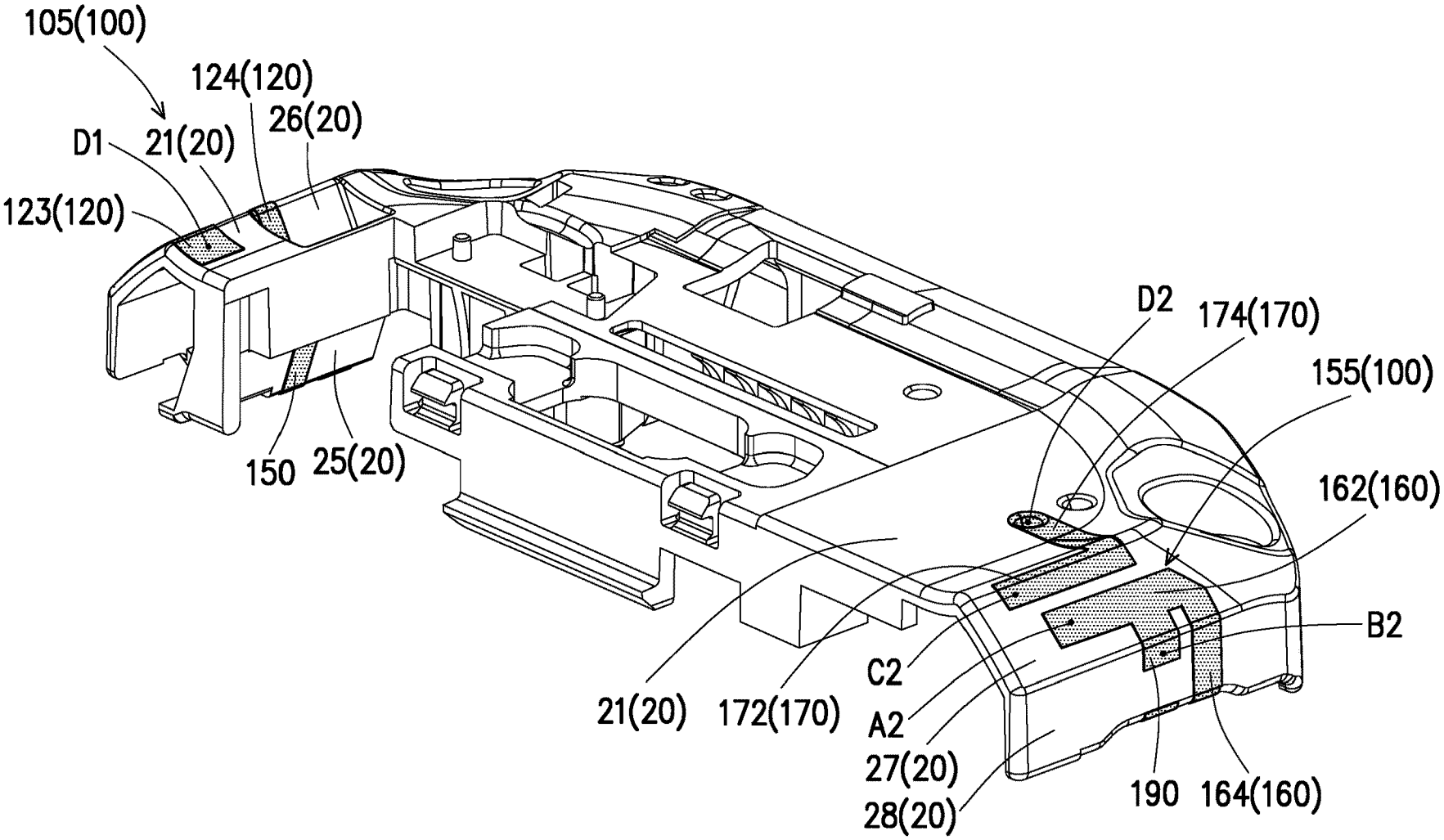
FIG. 7A is a schematic perspective view of FIG. 1 from another perspective.
Figure 7C:
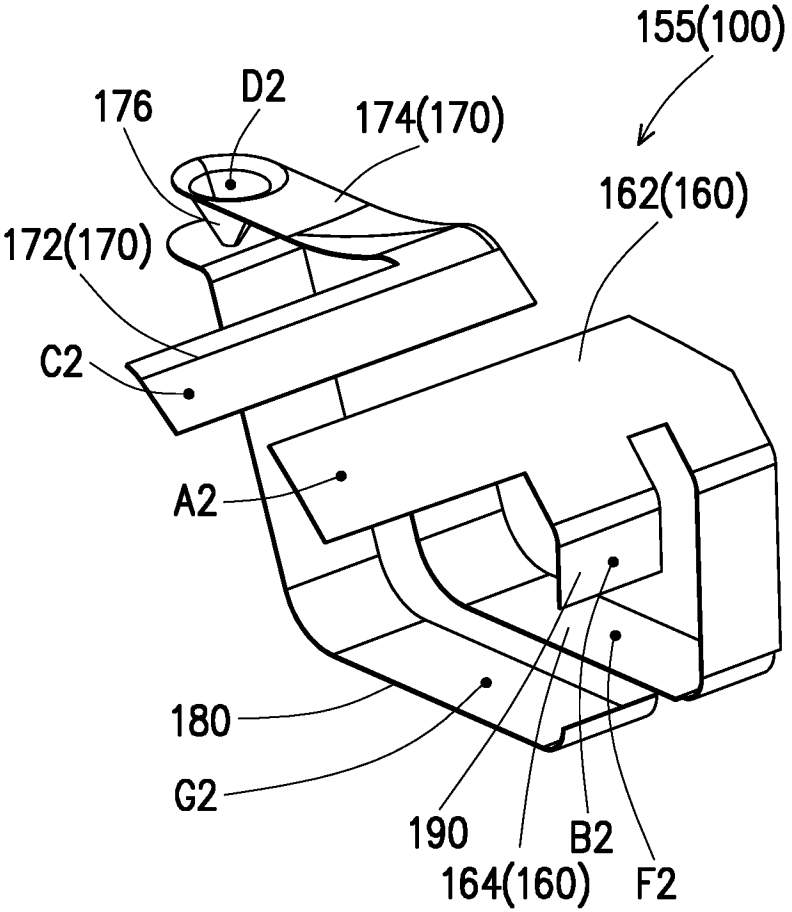
FIG. 7C is a schematic view of a second antenna of FIG. 7A.
Figure 7B:
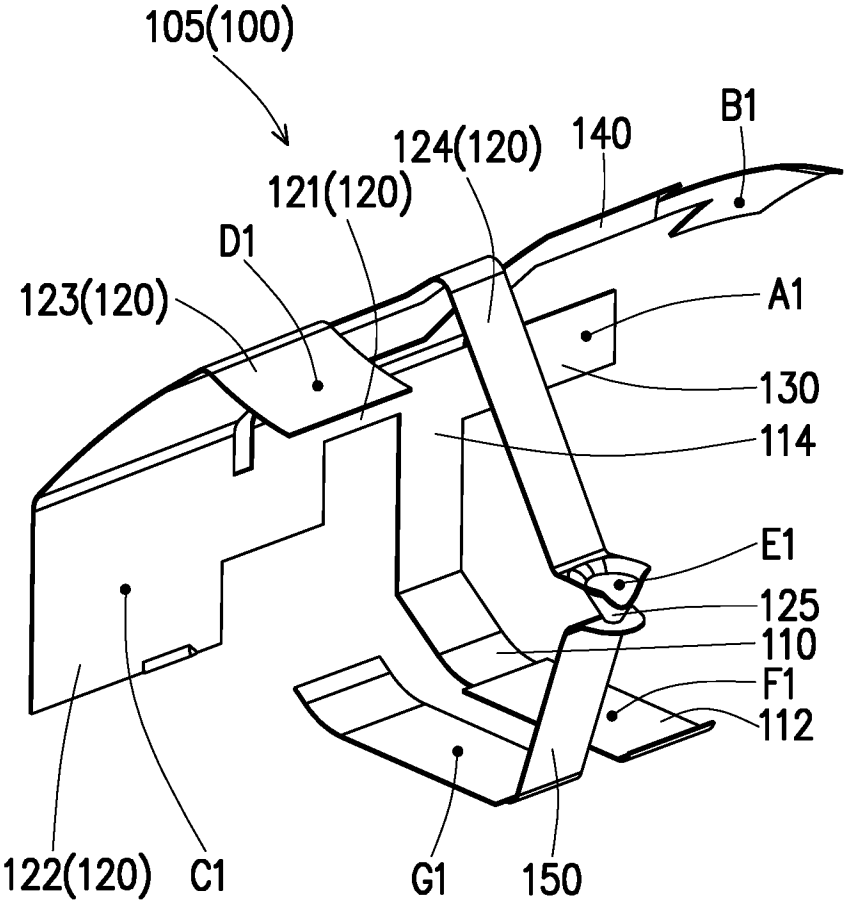
FIG. 7B is a schematic view of a first antenna of FIG. 7A.
Figure 8A:
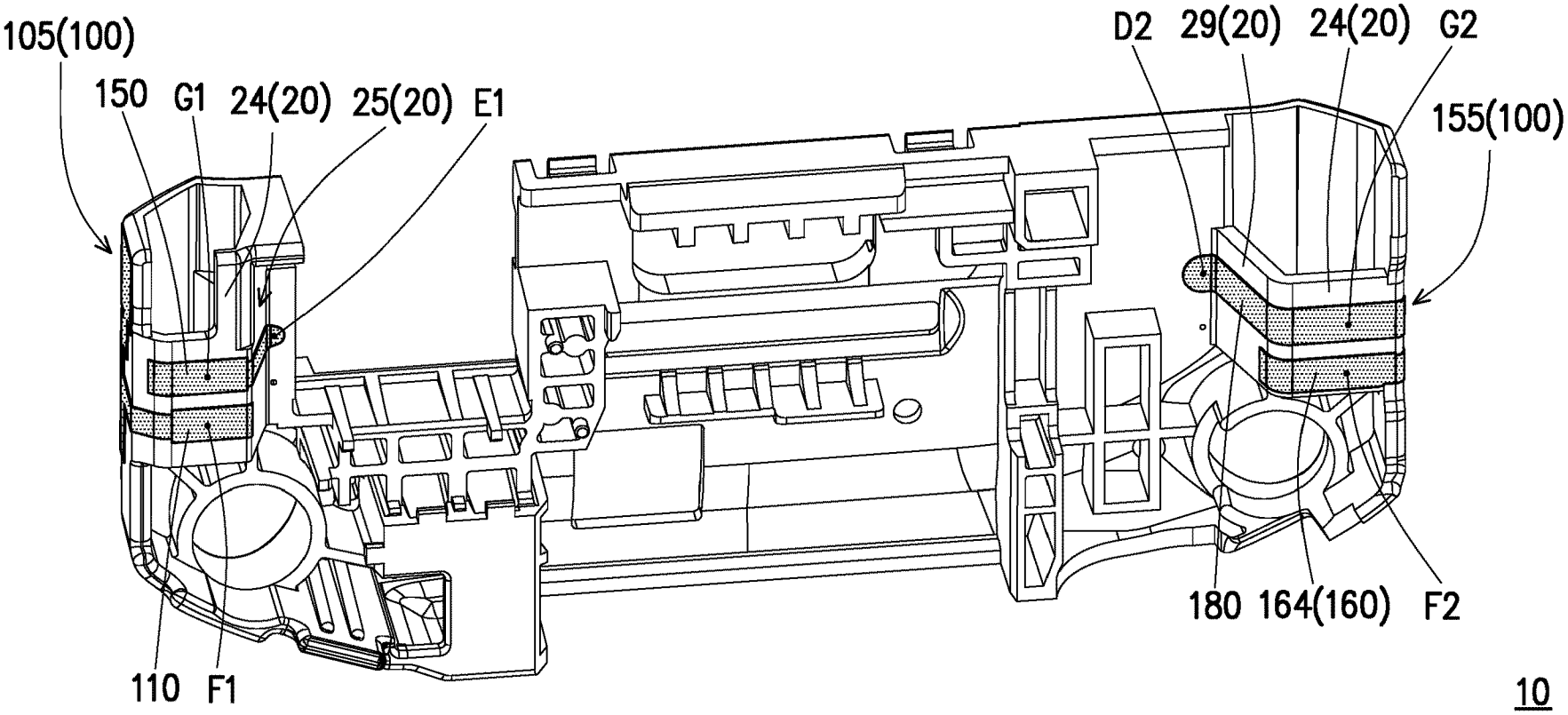
FIG. 8A is a schematic perspective view of FIG. 1 from another perspective.
Figure 8C:
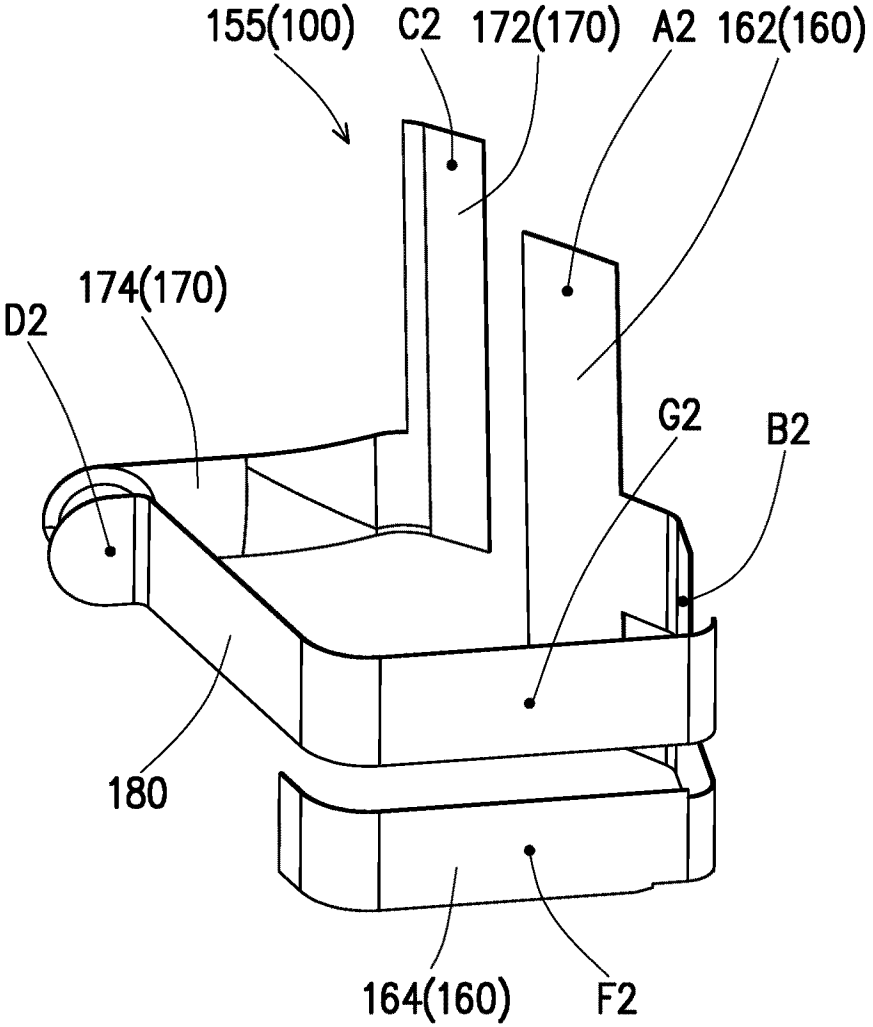
FIG. 8C is a schematic view of a second antenna of FIG. 8A.
Figure 8B:
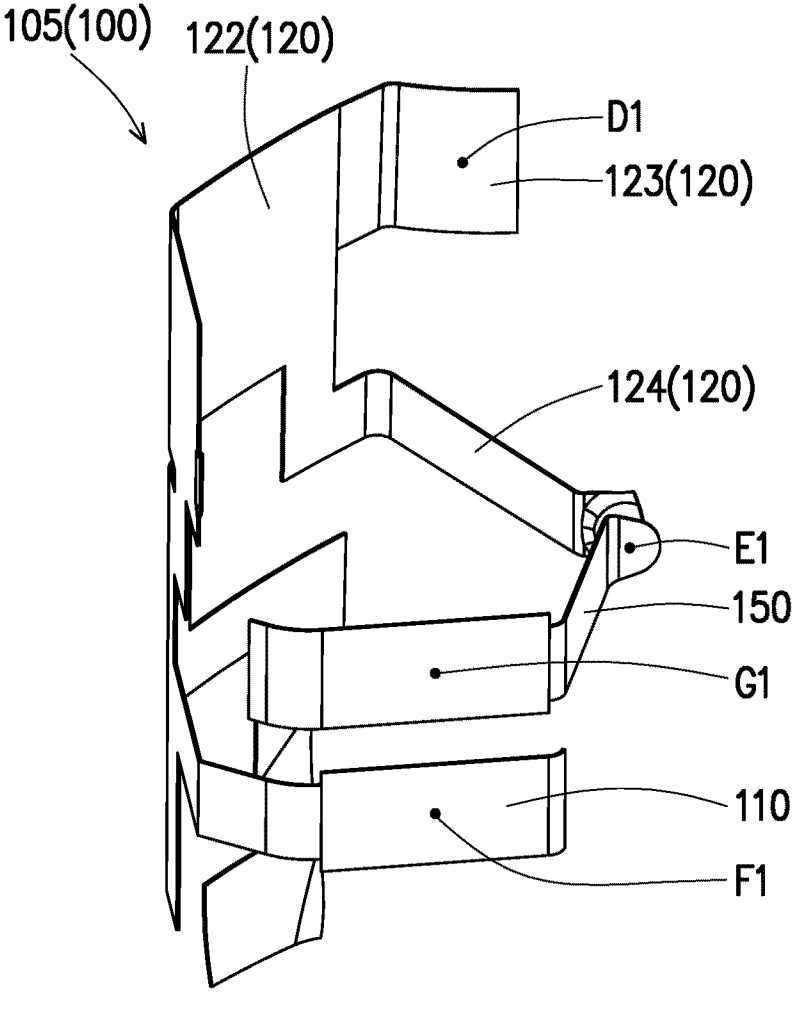
FIG. 8B is a schematic view of a first antenna of FIG. 8A.

FIG. 1 is a schematic top view illustrating that an antenna module according to an embodiment of the invention is disposed on a frame. FIG. 2 is a schematic view of the left side of FIG. 1. FIG. 3 is a schematic view of the right side of FIG. 1. FIG. 4 is a schematic bottom view of FIG. 1. FIG. 5A is a schematic perspective view of FIG. 1. FIG. 5B is a schematic view of a first antenna of FIG. 5A. FIG. 5C is a schematic view of a second antenna of FIG. 5A. FIG. 6A is a schematic perspective view of FIG. 1 from another perspective. FIG. 6B is a schematic view of a first antenna of FIG. 6A. FIG. 6C is a schematic view of a second antenna of FIG. 6A. FIG. 7A is a schematic perspective view of FIG. 1 from another perspective. FIG. 7B is a schematic view of a first antenna of FIG. 7A. FIG. 7C is a schematic view of a second antenna of FIG. 7A. FIG. 8A is a schematic perspective view of FIG. 1 from another perspective. FIG. 8B is a schematic view of a first antenna of FIG. 8A. FIG. 8C is a schematic view of a second antenna of FIG. 8A.

It should be noted that, in FIGS. 1 to 8C, in order to clearly illustrate the antenna module 100, the case of the electronic device 10 as well as other structures thereof are omitted, and only the antenna module 100 and a frame 20 or only the antenna module 100 is illustrated.

Referring to FIG. 1, the antenna module 100 of the embodiment is disposed on the frame 20 of the electronic device 10. The antenna module 100 includes a first antenna 105 and a second antenna 155. Each of the first antenna 105 and the second antenna 155 is able to resonate in a first frequency band, a second frequency band, and a third frequency band. In other words, even though the drawing illustrates that the first antenna 105 and the second antenna 155 are disposed on the frame 20, it is possible to dispose only the first antenna 105 on the frame 20 while meeting the multiple frequency demand in other embodiments.

In the embodiment, the first frequency band ranges between 2400 MHz and 2500 MHz, the second frequency band ranges between 5150 MHz and 5850 MHz, the third frequency band ranges between 6125 MHz and 7125 MHz, which meet the bandwidth requirement of WIFI 6E. Of course, the ranges of the first frequency band, the second frequency band, and the third frequency band are not limited to the above.

Referring to FIGS. 5B, 6B, and 7B, in the embodiment, the first antenna 105 includes a first radiator 110 (FIG. 7B), a second radiator 120 (FIG. 6B), a third radiator 130 (FIG. 6B), a fourth radiator 140 (FIG. 6B), and a fifth radiator 150 (FIG. 7B).

Specifically, in the embodiment, the first radiator 110 has a first end 112 (FIG. 7B) and a second end 114 (FIG. 6B) opposite to each other. The first end 112 is a first feeding end (position F1). As shown in FIG. 6B, the second radiator 120, the third radiator 130, and the fourth radiator 140 are connected to the second end 114 of the first radiator 110.

The second radiator 120 has a plurality of bending portions. Specifically, the second radiator 120 includes a first segment 121, a second segment 122, a third segment 123, and a fourth segment 124. The first segment 121 of the second radiator 120 is connected to the second end of the first radiator 110, and the first segment 121 of the second radiator 120 and the third radiator 130 extend in directions opposite to each other. The fourth radiator 140 extends, in a portion, in the direction toward the first segment 121 of the second radiator 120 and the third radiator 130 and then extends beside and in parallel to the third radiator 130.

As viewed from the perspective of FIG. 6B, the first segment 121 of the second radiator 120 extends horizontally, and the second segment 122 of the second radiator 120 is bent to be connected to the first segment 121 and extend in the vertical direction. A width W2 of the second segment 122 is greater than a width W1 of the first segment 121. In the embodiment, the width W2 of the second segment 122 is 2 times to 4 times of the width W1 of the first segment 121.

The third segment 123 and the fourth segment 124 are respectively bent to be connected to the top end of the second segment 122. A width W3 of the third segment 123 is greater than the width W1 of the first segment 121. In the embodiment, the width W3 of the third segment 123 is 1.5 times to 3 times of the width W1 of the first segment 121. In addition, the width W2 of the second segment 122 and the width W3 of the third segment 123 are also greater than the width of the fourth segment 124.

As shown in FIGS. 7B and 8B, the fifth radiator 150 is connected to the second radiator 120. Specifically, the fourth segment 124 of the second radiator 120 includes a first conductive hole 125 adapted to penetrate through the frame 20 for connection with the fifth radiator 150. The fifth radiator 150 has a first grounding end (position G1). In the embodiment, the fifth radiator 150 is located beside the first radiator 110 and parallel to the first radiator 110.

As shown in FIG. 7B, in the embodiment, the lengths of the first radiator 110, the second radiator 120, and the fifth radiator 150 (positions F1, C1, D1, E1, and G1) range between 0.23 times and 0.28 times of the wavelength of the first frequency band (such as 0.277 times of the wavelength, i.e., 38.6 mm). Accordingly, the first radiator 110, the second radiator 120, and the fifth radiator 150 (positions F1, C1, D1, E1, and G1) resonate in the first frequency band.

In addition, in the embodiment, as shown in FIG. 6B, the width W2 of the second segment 122 is greater than the width W1 of the first segment 121, and/or the width W3 of the third segment 123 is greater than the width W1 of the first segment 121. With such design, the first frequency band may be provided with a greater bandwidth.

Referring to FIG. 7B again, the lengths of the first radiator 110 and the third radiator 130 (positions F1, B1) range between 0.25 times and 0.35 times of the wavelength of the second frequency band (such as 0.31 times of the wavelength, i.e., 16.8 mm). Accordingly, the first radiator 110 and the third radiator 130 (positions F1, B1) resonate in the second frequency band.

The lengths of the first radiator 110 and the fourth radiator 140 (positions F1, A1) range between 0.25 times and 0.35 times of the wavelength of the third frequency band (such as 0.29 times of the wavelength, i.e., 13.6 mm). Accordingly, the first radiator 110 and the fourth radiator 140 (positions F1, A1) resonate in the third frequency band.

Referring to FIGS. 1, 2, 4, 5A, 6A, and 7A again, in this embodiment, the frame 20 includes a top surface 21 (FIGS. 1, 5A), a first inclined surface 22 (FIG. 6A), a first side surface 23 (FIG. 6A), a bottom surface 24 (FIG. 8A), a second inclined surface 25 (FIG. 8A), and a third inclined surface 26 (FIG. 5A) connected with one another. The second inclined surface 25 is located below the top surface 21 and connected to the bottom surface 24, and the third inclined surface 26 is connected to the top surface 21. The first antenna 105 is disposed on the top surface 21, the first inclined surface 22, the first side surface 23, the bottom surface 24, the second inclined surface 25, and the third inclined surface 26.

Specifically, as shown in FIGS. 8A and 6A, the first radiator 110 extends from the bottom surface 24 to the first side surface 23, and the first feeding end is located on the bottom surface 24. As shown in FIGS. 6A and 5A, the second radiator 120 extends from the first side surface 23 and the first inclined surface 22 to the top surface 21 and the third inclined surface 26. The third radiator 130 is disposed on the first side surface 23, and the fourth radiator 140 is disposed on the first inclined surface 22. As shown in FIG. 8A, the fifth radiator 150 extends from the bottom surface 24 to the second inclined surface 25, and the first grounding end is located on the bottom surface 24. As shown in FIGS. 5A and 8A, the second radiator 120 is connected to the fifth radiator 150 through the first conductive hole 125 penetrating through the frame 20.

With the above configuration, the first antenna 105 may be disposed on different surfaces of the frame 20 according to the shape of the frame 20 without an extra carrier plate. Thus, the first antenna 105 is space-efficient and applicable for multiple frequency bands.

In the following, the second antenna 155 is described. Referring to FIGS. 5C, 6C, 7C and 8C, in the embodiment, the second antenna 155 includes a sixth radiator 160 (FIG. 7C), a seventh radiator 170 (FIG. 7B), an eighth radiator 180 (FIG. 6C), and a ninth radiator 190 (FIG. 7C).

In the embodiment, the sixth radiator 160 includes a fifth segment and a sixth segment 164 perpendicular to the fifth segment 162. The sixth radiator 160 has a second feeding end (FIG. 8C) located at the sixth segment 164.

As shown in FIG. 7C, a portion of the seventh radiator 170 is disposed beside and in parallel to the fifth segment 162 of the sixth radiator 160. Specifically, the seventh radiator 170 has a seventh segment 172 and an eighth segment 174 bent to be connected. The seventh segment 172 of the seventh radiator 170 is parallel to the fifth segment 162 of the sixth radiator 160, and the eighth segment 174 of the seventh radiator 170 is parallel to the sixth segment 164 of the sixth radiator 160 and extends in a direction away from the sixth segment 164.

As shown in FIG. 6C, the eighth segment 174 of the seventh radiator 170 includes a second conductive hole 176 adapted to penetrate through the frame 20 for connection with the eighth radiator 180. Hence, the eighth radiator 180 is connected to the seventh radiator. The eighth radiator 180 has a second grounding end. A portion of the eighth radiator 180 is disposed beside and in parallel to the sixth segment 164 of the sixth radiator 160.

As shown in FIG. 7C, the ninth radiator 190 extends vertically from the fifth segment 162 of the sixth radiator 160 and is parallel to the sixth segment 164 of the sixth radiator 160.

In the embodiment, the lengths of the sixth radiator 160, the seventh radiator 170, and the eighth radiator 180 (positions F2, A2, C2, D2, and G2) range between 0.25 times and 0.3 times of the wavelength of the first frequency band (such as 0.283 times of the wavelength, i.e., 39.1 mm). Accordingly, the sixth radiator 160, the seventh radiator 170, and the eighth radiator 180 (positions F2, A2, C2, D2, and G2) resonate in the first frequency band.

The length of the sixth radiator 160 (positions F2, A2) ranges between 0.25 times and 0.3 times of the wavelength of the second frequency band (such as 0.32 times of the wavelength, i.e., 17.3 mm). Accordingly, the sixth radiator 160 (positions F2, A2) resonates in the second frequency band.

The lengths of a portion of the sixth radiator 160 and the ninth radiator 190 (positions F2, B2) range between 0.25 times and 0.3 times of the wavelength of the third frequency band (such as 0.33 times of the wavelength, i.e., 15.8 mm). Accordingly, the portion of the sixth radiator 160 and the ninth radiator 190 (positions F2, B2) resonate in the third frequency band.

Referring to FIGS. 1, 2, 4, 5A, 6A, and 7A again, in this embodiment, the frame 20 includes the top surface 21 (FIGS. 1, 5A), a fourth inclined surface 27 (FIG. 7A), a second side surface 28 (FIG. 7A), the bottom surface 24 (FIG. 8A), and a fifth inclined surface 29 (FIG. 8A) connected with one another. The fifth inclined surface 29 is located below the top surface 21 and connected to the bottom surface 24 (FIG. 8A). The second antenna 155 is disposed on the top surface 21, the fourth inclined surface 27, the second side surface 28, the bottom surface 24, and the fifth inclined surface 25.

Specifically, as shown in FIGS. 8A and 7A, the sixth radiator 160 extends from the bottom surface 24 and the second side surface 28 to the fourth inclined surface 27, and the second feeding end is located on the bottom surface 24. As shown in FIG. 7A, the seventh radiator 170 extends from the fourth inclined surface 27 to the top surface 21. The seventh radiator 170 is connected to the eighth radiator 180 via the second conductive hole 176. As shown in FIG. 8A, the eighth radiator 180 extends from the fifth inclined surface 29 to the bottom surface 24, and the second grounding end is located on the bottom surface 24.

Figure 9:
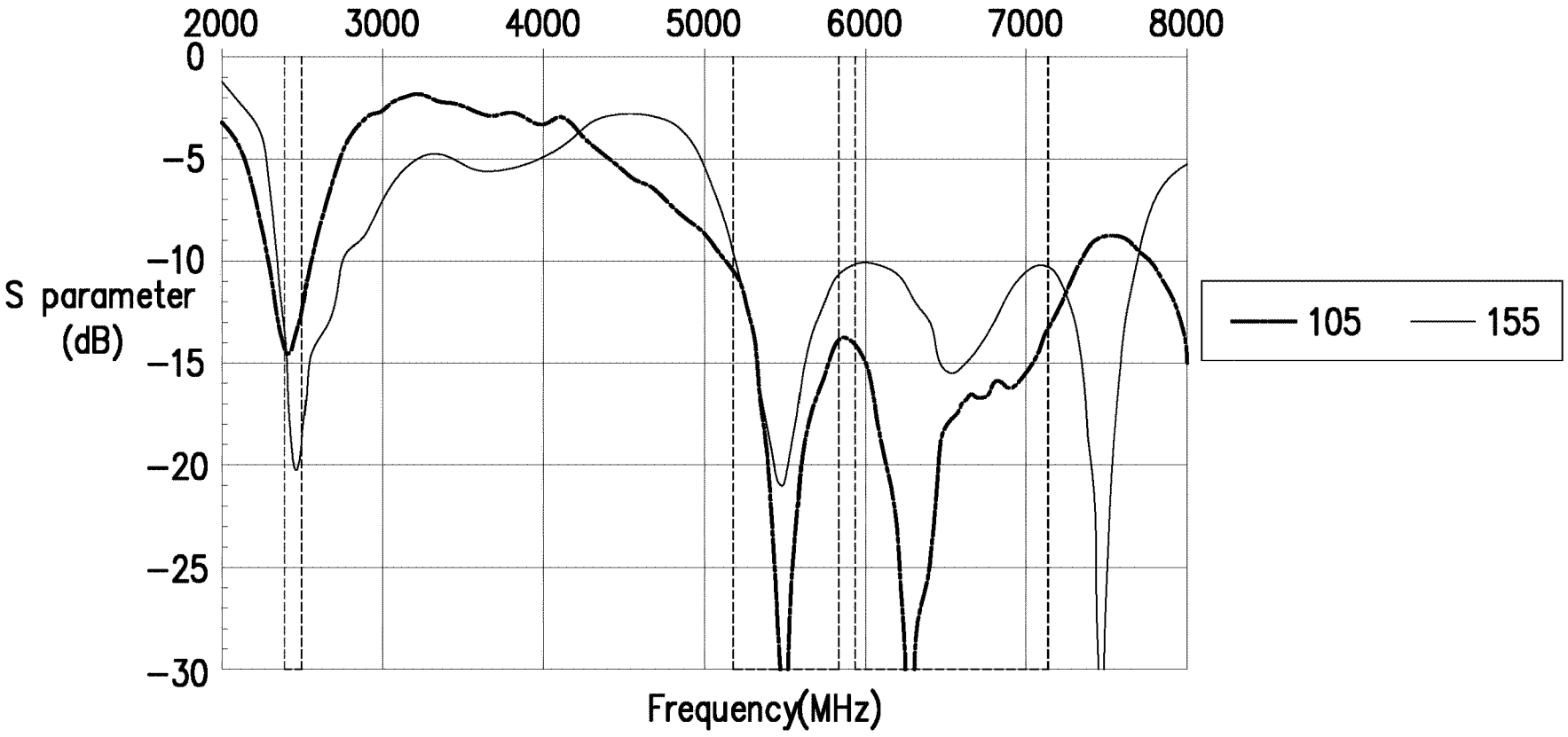
FIG. 9 is a diagram illustrating a relationship between frequency and S parameter of the antenna module of FIG. 1.

FIG. 9 is a diagram illustrating a relationship between frequency and S parameter of the antenna module of FIG. 1. Referring to FIG. 9, the first antenna 105 and the second antenna 155 have the S parameters (S11, S22) less than −10 in the first frequency band, the second frequency band, and the third frequency band and thus exhibit favorable performance.

Figure 10:
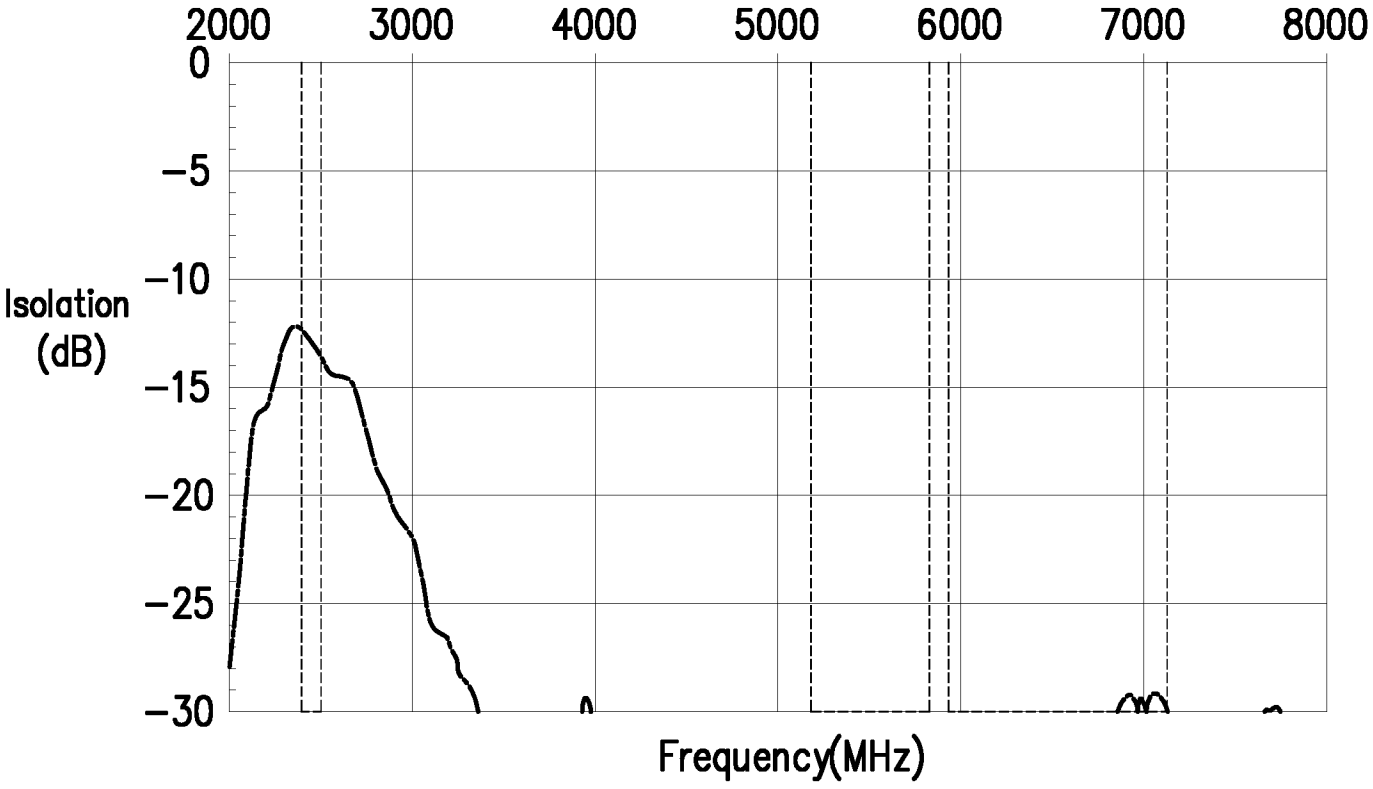
FIG. 10 is a diagram illustrating a relationship between frequency and isolation of the antenna module of FIG. 1.

FIG. 10 is a diagram illustrating a relationship between frequency and isolation of the antenna module of FIG. 1. Referring to FIG. 10, the first antenna 105 and the second antenna 155 exhibit an isolation less than −10 dB and thus render favorable performance.

In addition, the antenna average efficiency of the first antenna 105 at 2.4 GHz is 54.67%, −2.39 dB. The antenna efficiency at 5 GHz is 61.19%, −2.1 dB. The antenna efficiency at 6 GHz is 49.21%, −3.06 dB. The antenna average efficiency of the second antenna 155 at 2.4 GHz is 54.86%, −2.66 dB. The antenna efficiency at 5 GHz is 56.84%, −2.45 dB. The antenna efficiency at 6 GHz is 42.02%, −3.76 dB. The first antenna 110 and the second antenna 120 exhibit antenna efficiencies all greater than 45% in the aforementioned frequency bands, and therefore exhibit favorable antenna radiation characteristics.

Based on the above, in the antenna module according to the embodiments of the invention, the first end of the first radiator is provided with the first feeding end, the second radiator, the third radiator, and the fourth radiator are connected to the second end of the first radiator, the fifth radiator is connected to the second radiator, and the fifth radiator has the first grounding end. The first radiator, the second radiator and the fifth radiator resonate in the first frequency band, the first radiator and the third radiator resonate in the second frequency band, and the first radiator and the fourth radiator resonate in the third frequency band. With the above configuration, the antenna module according to the embodiments of the invention is able to meet the demand for multiple frequency bands.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An antenna module, comprising:

a first antenna, comprising a first radiator, a second radiator, a third radiator, a fourth radiator, and a fifth radiator, wherein the first radiator has a first end and a second end opposite to each other, the first end is a first feeding end, the second radiator, the third radiator and the fourth radiator are connected to the second end of the first radiator, the second radiator has a plurality of bending portions, the fifth radiator is connected to the second radiator, and the fifth radiator has a first grounding end, wherein the first radiator, the second radiator and the fifth radiator resonate in a first frequency band, the first radiator and the third radiator resonate in a second frequency band, and the first radiator and the fourth radiator resonate in a third frequency band.

2. The antenna module as claimed in claim 1, wherein the second radiator comprises a first segment, a second segment, a third segment, and a fourth segment, the first segment is connected to the second end of the first radiator, the second segment is bent and connected to the first segment, the third segment and the fourth segment are respectively bent and connected to the second segment, and widths of the second segment and the third segment are respectively greater than widths of the first segment and the fourth segment.

3. The antenna module as claimed in claim 2, wherein the width of the second segment is 2 times to 4 times of the width of the first segment.

4. The antenna module as claimed in claim 2, wherein the width of the third segment is 1.5 times to 3 times of the width of the first segment.

5. The antenna module as claimed in claim 2, wherein the first segment of the second radiator and the third radiator extend in directions opposite to each other.

6. The antenna module as claimed in claim 2, wherein the fourth segment of the second radiator comprises a first conductive hole adapted to penetrate through a frame for connection with the fifth radiator.

7. The antenna module as claimed in claim 1, wherein the fifth radiator s located beside the first radiator and parallel to the first radiator.

8. The antenna module as claimed in claim 1, wherein the first frequency band ranges between 2400 MHz and 2500 MHz, the second frequency band ranges between 5150 MHz and 5850 MHz, and the third frequency band ranges between 6125 MHz and 7125 MHz.

9. An electronic device, comprising:

a frame, comprising a top surface, a first inclined surface, a first side surface, a bottom surface, a second inclined surface, and a third inclined surface connected with one another, wherein the second inclined surface is located below the top surface and connected with the bottom surface, and the third inclined surface is connected with the top surface; and the antenna module as claimed in claim 1, wherein the first antenna is disposed on the top surface, the first inclined surface, the first side surface, the bottom surface, the second inclined surface, and the third inclined surface.

10. The electronic device as claimed in claim 9, wherein the first radiator extends from the bottom surface to the first side surface, the first feeding end is located on the bottom surface, the second radiator extends from the first side surface and the first inclined surface to the top surface and the third inclined surface, the third radiator is disposed on the first side surface, the fourth radiator is disposed on the first inclined surface, the fifth radiator extends from the bottom surface to the second inclined surface, and the first grounding end is located on the bottom surface.

* * * * *